United States Patent [19]

List

[11] 4,039,024

[45] Aug. 2, 1977

[54] HEAT EXCHANGER

[76] Inventor: Heinz List, St. Jakobsstrasse 43, Pratteln, Switzerland

[21] Appl. No.: 575,010

[22] Filed: May 6, 1975

Related U.S. Application Data

[63] Continuation of Ser. No. 416,791, Nov. 19, 1973, abandoned.

[30] Foreign Application Priority Data

Nov. 21, 1972 Switzerland ..... 16913/72

[51] Int. Cl.[2] ..... F28F 5/04

[52] U.S. Cl. ..... 165/92; 165/120

[58] Field of Search ..... 165/86–92; 34/125, 6, 135, 192

[56] References Cited

U.S. PATENT DOCUMENTS

| | | | |
|---|---|---|---|
| 2,328,395 | 8/1943 | Neuman | 165/87 |
| 2,540,250 | 2/1951 | Feldstein et al. | 165/92 X |
| 2,594,142 | 4/1952 | Feldstein et al. | 165/92 X |
| 2,798,693 | 7/1957 | Bojner | 34/135 |
| 3,020,025 | 2/1962 | O'Mara | 165/87 |
| 3,263,748 | 8/1961 | Jemal et al. | 165/120 X |
| 3,500,901 | 3/1970 | Root, 3rd et al. | 165/86 |

*Primary Examiner*—Carroll B. Dority, Jr.
*Assistant Examiner*—Theophil W. Streule, Jr.
*Attorney, Agent, or Firm*—Toren, McGeady and Stanger

[57] ABSTRACT

In a heat exchanger for treating a flowable material, a multiplicity of disc elements are secured to and extend transversely of a shaft rotatably mounted within a casing. Disc elements are arranged in a number of planes extending transversely of the shaft and spaced apart in the axial direction. Material to be treated is introduced into the casing and is moved through it in the axial direction of the shaft by the disc elements and stirrer elements secured to the disc elements. The stirrer elements extend in the axial direction of the shaft and can be continuous for the extent of the disc elements or they can extend between adjacent disc elements or be supported by an individual one of the disc elements. In a preferred arrangement, the stirrer elements are bar-shaped and are located at the radially outer edges of the disc elements.

10 Claims, 8 Drawing Figures

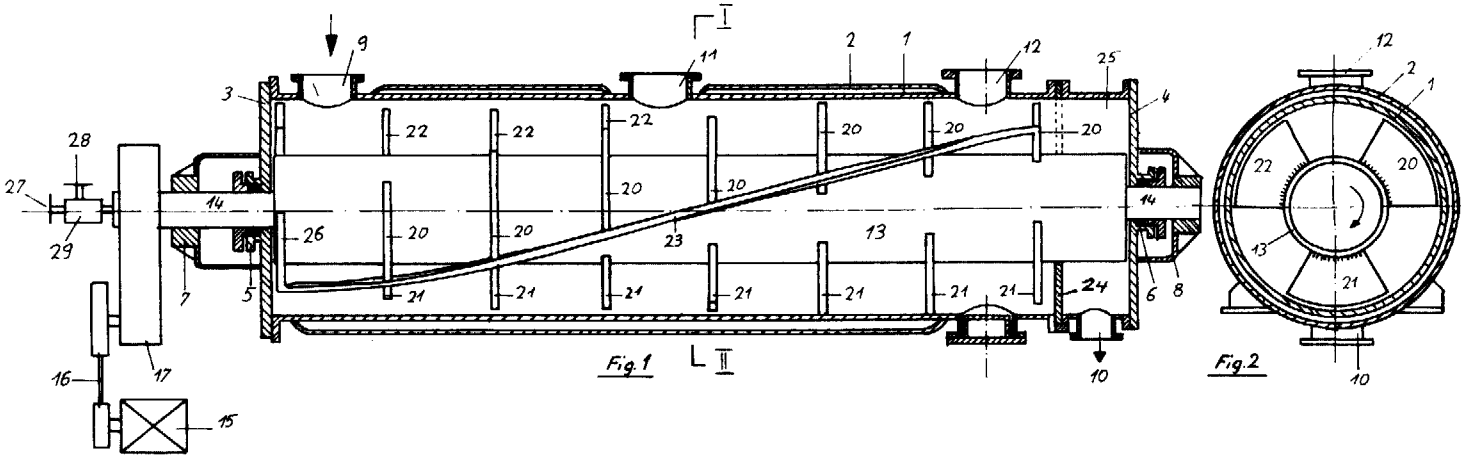
Fig. 1
Fig. 2
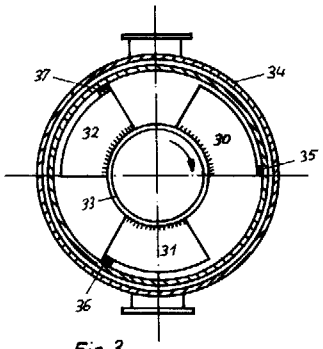
Fig. 3
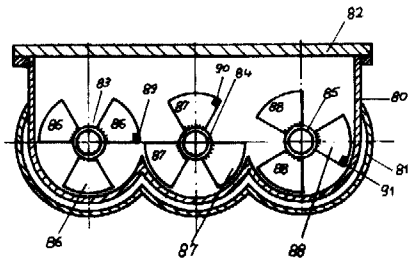
Fig. 4

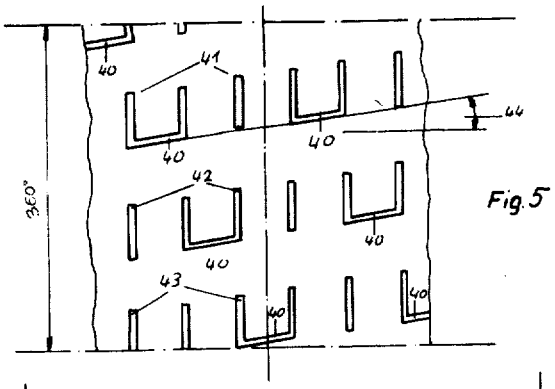
Fig. 5
Fig. 6
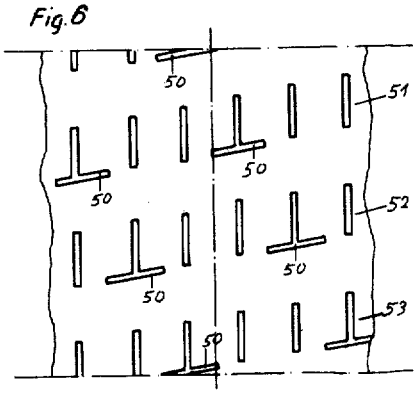
Fig. 7
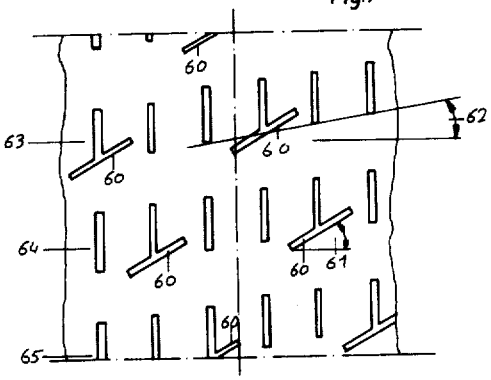
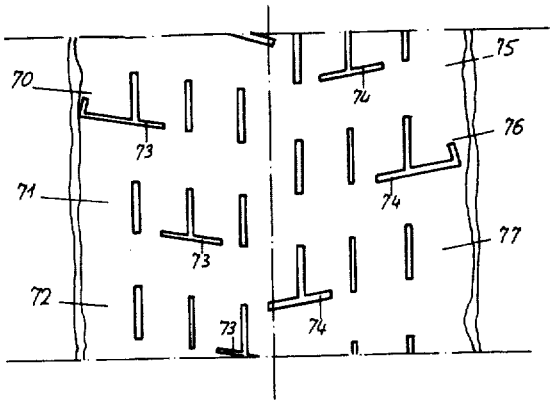
Fig. 8

HEAT EXCHANGER

This is a continuation of application Ser. No. 416,791, filed Nov. 19, 1973, now abandoned.

SUMMARY OF THE INVENTION

The present invention is directed to a heat exchanger which is particularly useful in treating flowable products and it is especially concerned with the arrangement of stirrer elements attached to disc-shaped elements which in turn are mounted on a centrally arranged rotatable shaft within the casing. The disc elements extend transversely of the shaft while the stirrer elements or bars attached to the disc elements extend in the axial direction of the shaft.

Heatable and coolable screw-type apparatus are used at the present time for heating and cooling solid materials or sludgy suspensions of solid materials and liquids and also for evaporation and drying processes, where the material is moved over the heated or cooled surfaces by belts or scrapers.

The primary object of the present invention is to achieve a maximum heat transfer in a minimum of space by providing large heat exchanging surfaces and good surface contact between the heat exchanging surfaces and the material to be treated.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWING

In the drawing

FIG. 1 is a longitudinal sectional view of a heat exchanger illustrating one embodiment of the present invention;

FIG. 2 is a transverse cross sectional view through the heat exchanger of FIG. 1 along the line I–II;

FIG. 3 is a transverse cross sectional view similar to FIG. 2 but illustrating a modified form of the embodiment shown in FIGS. 1 and 2;

FIG. 4 is a transverse cross sectional view of another embodiment of the present invention;

FIG. 5 is a developed view of one embodiment of the present invention illustrating the manner in which certain parts of the apparatus are joined together;

FIG. 6 is another developed view, similar to FIG. 5, showing still another arrangement of the manner in which parts of the apparatus are connected together;

FIG. 7 is yet another developed view, similar to FIG. 6, but indicating a variation in the angular disposition of the parts connected to one another; and FIG. 8 is a further developmental view of the parts suitable for use in intermittent operations.

DETAILED DESCRIPTION OF THE INVENTION

In FIGS. 1 and 2, a compact design of the present invention is illustrated and includes a cylindrical housing 1 laterally enclosed by a jacket 2 providing a flow space between the housing and the jacket for the passage of a heat transfer medium. The housing 1 is closed at its end by end members 3 and 4, each of which it provided with a stuffing box 5, 6 to afford a sealing action and also with a bearing support 7, 8 for supporting a stirring shaft 13. Adjacent one end of the shaft, the housing has an opening 9 and adjacent its other end there is an opening 10, so that the flowable material to be treated can be supplied into and removed from the housing. Further, intermediate the openings 9 and 10, other openings 11, 12 are provided which serve to exhaust gases and vapors, or in reaction processes, can be used to supply additional materials. The stirring shaft 13 rotates with the shaft journals 14 mounted in the bearing supports 7, 8 and the shaft is driven by a motor 15 over a V-belt drive 16 and a transmission gear 17. Disc elements 20, 21 and 22 are secured to and extend radially outwardly from the stirring shaft 13. By an inspection of FIGS. 1 and 2, it can be noted that the disc elements 20, 21 and 22 are arranged in a number of radial planes extending perpendicularly of the shaft axis and the adjacent and radially outwardly extending edges of the disc elements are spaced apart to define passage extending outwardly from the shaft to the casing so as to permit the free flow of the products passing through the plane of the disc elements. Further, the radially outer edges of each of the disc elements are located closely spaced from the inner surface of the housing so that a narrow clearance remains permitting the disc elements to be rotated relative to the surface of the housing.

At the end member 3, a scraper 26 is secured to and extends outwardly from the shaft 13. As illustrated in FIG. 1, the forward edge of the scraper 26 and of each of the elements 20, that is, the leading edge in the direction of rotation of the shaft, are connected by a continuous stirrer element or bar 23, so that the material being treated within the housing is moved by the rotation of the shaft from the supply opening 9 to the discharge opening 10. As can be seen in FIG. 1, the continuous stirrer bar 23 extends in the axial direction of the shaft, but is disposed at an angle to the axial direction. The velocity of movement of the material is determined by the slope of the stirrer bar 23 and by the speed of the shaft 13. If necessary, the disc elements 21 and 22 can also be provided with a similar stirrer bar. In addition to the feeding, the requirement for effective heat transfer is also determined by the arrangement of the stirrer bars, since the bars increase the exchange of the material by a reshoveling action as the material passes between adjacent planes of discs. However, if only one stirrer bar is used, the heat transfer surface can be increased if the spacing between the disc elements 21 and 22 in the same plane as well as between 22 and 20 are closed so that only a space or gap is provided between disc elements 20 and 21 for providing the movement of the material in the axial direction of the shaft. To insure proper filling of the material in the machine, a baffle plate 24 is arranged adjacent to and in the path of movement of the material to the discharge opening 10. Further, it is also possible to provide additional stirrer arms on the shaft, if necessary, at the discharge end 25 of the casing. The heating of the hollow stirring shaft 13 and of the disc elements extending outwardly from the shaft can be effected in a known manner with the heat transfer medium passing through the inlet 27 for flow into the shaft and being removed through the outlet 28 after the completion of its passage through the heat transfer flow path within the housing. The connection of the inlet 27 and the outlet 28 can be provided through a stuffing box head 29.

In FIG. 3, a variation in the arrangement of the stirrer bars on the disc elements is shown with three disc elements 30, 31 and 32 mounted on the shaft and extending outwardly toward but spaced inwardly from the surface of the housing 34 by an amount equal to the thickness of stirrer bars 35, 36 and 37 fixed to the radially outer edges of the disc elements. The stirrer bars 35, 36 and 37 are attached to the leading end of each of the radially outer edges of the disc elements and a spacing is provided between the casing surface and the stirrer bars so that relative movement between the two is possible.

In FIGS. 5, 6, 7 and 8, developed views of various stirring embodiments are illustrated where the circumferential surface of the casing has been opened or developed into a plane. In FIG. 5, stirrer bars 40 are arranged in a staggered arrangement between adjacent rows of the disc elements and each stirrer bar connects two adjacent disc elements 41, 42 and 43 in adjacent radially extending planes. As can be seen in each axially extending row of the disc elements, two disc elements are connected by a stirrer bar, then one disc element is left free of the stirrer bar and the next two disc elements are connected by a stirrer bar. The axially extending edge of the stirrer bars and of the disc elements are arranged at a feed angle designated as 44 which is disposed at an angle to the axis of the shaft.

In FIG. 6, stirrer bars 50 are provided and each of the stirrer bars is secured to only one disc element 51, 52 and 53. The axially extending surfaces of the stirrer bars are disposed at an angle to the axis of the shaft, similar to that shown in FIG. 5. As can be seen, there is one stirrer bar 50 for each three disc elements 51, 52, 53 extending in axial rows.

While the angle at which the stirrer bars are secured to the disc elements relative to the axis of the shaft is the same as the angle at which the front edges of the disc elements are arranged relative to the shaft, in FIG. 7, the axially extending surfaces of stirrer bars 60 are arranged at a greater angle 61 than the angle 62 of the front or leading edges of the disc elements 63, 64, and 65 so that an increased feeding effect is obtained.

In FIGS. 1, 5, 6 and 7, continuous feeding or working apparatus is shown. However, in FIG. 8, an arrangement of disc elements and stirrer bars is shown for use in an intermittent heat exchanger. In this heat exchanger, disc elements 70, 71 and 72 and stirrer bars 73 feed the material from the left toward the center and disc elements 75, 76 and 77 along with stirrer bars 74 feed the material from the right toward the center of the apparatus. The material accumulated or fed to the center returns in the upper part of the heat exchanger from the center toward the end walls so that a desired internal circulation is obtained.

In FIG. 4, instead of a cylindrical housing, a box-type member is provided formed of a common trough 80 enclosed with a jacket 81, for forming a heat transfer medium flow space, and closed at its upper surface by a cover 82. Within the common trough 80, three individual sub-troughs are provided, each containing a stirring shaft 83, 84 and 85 with the shafts arranged in parallel relation. Each of the shafts has a number of planes of disc elements 86, 87 and 88 extending outwardly from the shaft and terminating close to the lower surface in each sub-trough. Additionally, a stirrer bar 89, 90 and 91 is attached to the leading edge of each disc element at its radially outer edge.

The heating and cooling of the heat transfer surfaces is effected in a known manner by use of steam or a liquid heating and cooling medium. Further, in a particular case, electrical means can be used to transfer heat to the material being treated or the heating medium can be a gas.

While a specific embodiment of the invention has been shown and described in detail to illustrate the application of the inventive principles, it will be understood that the invention may be embodied otherwise without departing from such principles.

What is claimed is:

1. Heat exchanger, particularly for treating flowable products, comprising a horizontally arranged axially elongated casing at least partly cylindrical in the circumferential direction transverse to the elongated direction thereof and closed at its ends forming an axially elongated space therein, said casing having a first opening adjacent one end for admitting material to be treated and a second opening adjacent its opposite end for removing the material after it is moved through said space, a shaft rotatably mounted in said casing and extending centrally through said space therein in the axially elongated direction of said casing, a plurality of disc elements secured to and extending radially outwardly from said shaft substantially perpendicularly of the axial direction of said shaft, each said disc element having a radially inner edge secured to said shaft, a radially outer edge spaced outwardly from said shaft and located closely adjacent the at least partly cylindrical surface of said casing for permitting movement of said disc elements relative to said casing, a first edge and a second edge spaced apart from one another around said shaft and extending outwardly from said inner edge to said outer edge, said first edge leading said second edge in the direction of rotation of said shaft, said disc elements providing a continuous imperforate surface from said shaft to the radially outer edge thereof and between said first and second edges thereof, said disc elements arranged in a number of uniformly axially spaced parallel planes extending between the first and second opening and each said plane disposed substantially perpendicularly of the axial direction of said shaft and containing at least one said disc element extending around said shaft said disc elements with the first and second edges thereof spaced apart and forming a passage extending outwardly from said shaft to said casing so that at least one passage is provided in each plane of said disc elements for permitting the flowable products to pass therethrough in moving from the first opening to the second opening in said casing stirrer means for moving the flowable product from the first opening to the second opening in said casing, said stirrer means extending for approximately the axial length of said casing between the plane of said disc elements closest to said second opening, said stirring means comprising at least one stirrer element secured to at least certain ones of said disc elements disposed in spaced planes of said disc elements and located at the intersections of said first edges and said radially outer edges thereof and extending generally in the axial direction of said shaft, the radially outer surface of said stirrer element being spaced closely from the inner surface of said casing for permitting movement of said stirrer element rlative to said casing, the leading edge of said stirrer element facing in the direction of rotation of said shaft extends generally in the axial direction of said shaft and is arranged at an angle to the axis of the shaft, the at least one opening located in each plane of said disc elements being positioned at the first edge of said disc element on which said stirrer element is secured so that the flowable product moved by said stirrer element passes through the at least one opening, and the openings between said disc elements in adjacent planes of said disc elements following the angular disposition of said at least one stirrer element for facilitating the passage of the flowable product through the space in said casing, and a baffle plate located within said casing and extending perpendicularly of the axial direction of said shaft from the lower inner surface of said casing in the upward direction, said baffle plate located between said second opening and said plane of said disc elements most closely adjacent to said second opening for maintaining a certain filling level in said space.

2. Heat exchanger, as set forth in claim 1, wherein the stirrer element is a continuous member extending from one said disc element located most closely adjacent said first opening into said space in said casing through said space and to one of said disc elements located in the plane most closely adjacent to second opening from said space.

3. Heat exchanger, as set forth in claim 1, wherein a plurality of said stirrer elements are located within said space and each said stirrer element joins at least two said disc elements located in adjacent axially spaced planes.

4. Heat exchanger, as set forth in claim 1, wherein a plurality of said stirrer elements are located within said space and each said stirrer element is individually supported on a single one of said disc elements.

5. Heat exchanger, as set forth in claim 1, wherein said stirrer elements are secured to the leading ends of said radially outer edges, that is, the ends facing in the direction of rotation of said disc elements on said shaft.

6. Heat exchanger, as set forth in claim 5, wherein the radially outer edges of said stirrer elements are in line with the radially outer edges of said disc elements to which they are attached.

7. Heat Exchanger, as set forth in claim 1, wherein said stirrer elements project radially outwardly from the outer edges of said disc elements so that the radially outer surface of said disc elements are spaced from the inner surface of said casing by a dimension equal to the radial dimension of said stirrer elements plus sufficient clearance so that said stirrer elements move relative to the inner surface of said casing.

8. Heat exchanger, as set forth in claim 1, wherein said casing is a box-like member having a width which is a multiple of its height and said member divided into a plurality of individual side-by-side troughs, one said shaft extending through each of said troughs for increasing the heat transfer surface in the heat exchanger.

9. Heat exchanger, as set forth in claim 1, wherein a jacket located laterally outwardly from and enclosing said casing forms a flow space therebetween for passing a heat transfer medium therethrough.

10. Heat exchanger, as set forth in claim 1, including means for flowing a heat transfer medium through said shaft within said space in said casing.

* * * * *